US007902981B2

(12) United States Patent
Kaise et al.

(10) Patent No.: US 7,902,981 B2
(45) Date of Patent: Mar. 8, 2011

(54) IMAGE DISPLAY DEVICE

(75) Inventors: Naoki Kaise, Higashiosaka (JP); Hidetomo Kawashige, Neyagawa (JP)

(73) Assignee: Sanyo Electric Co., Ltd., Moriguchi-shi, Osaka (JP)

( * ) Notice: Subject to any disclaimer, the term of this patent is extended or adjusted under 35 U.S.C. 154(b) by 419 days.

(21) Appl. No.: 11/871,324

(22) Filed: Oct. 12, 2007

(65) Prior Publication Data

US 2008/0088446 A1 Apr. 17, 2008

(30) Foreign Application Priority Data

Oct. 12, 2006 (JP) ..... 2006-278873

(51) Int. Cl.
*G08B 13/14* (2006.01)

(52) U.S. Cl. ..... 340/571; 340/568.1; 340/568.2; 340/540; 340/572.1; 340/7.6; 340/545.2

(58) Field of Classification Search ..... 340/571, 340/5.31, 568.1, 522, 572.1, 568.2, 540, 340/582, 7.6, 545.2, 693.3, 568.8, 426.6, 340/937; 70/57.1
See application file for complete search history.

(56) References Cited

U.S. PATENT DOCUMENTS 3,836,901 A * 9/1974 Matto et al. ..... 340/522
4,121,201 A * 10/1978 Weathers ..... 340/524
4,284,983 A * 8/1981 Lent ..... 340/522
4,494,114 A * 1/1985 Kaish ..... 340/5.31
4,750,136 A * 6/1988 Arpin et al. ..... 710/10
5,017,913 A * 5/1991 Kaneko et al. ..... 345/177
5,032,971 A * 7/1991 Yamada ..... 363/65
5,068,643 A * 11/1991 Yashina ..... 340/571
5,191,648 A * 3/1993 Ikenoue et al. ..... 709/208
5,406,261 A * 4/1995 Glenn ..... 340/571
5,578,991 A * 11/1996 Scholder ..... 340/571
5,757,270 A * 5/1998 Mori ..... 340/568.1
5,760,690 A * 6/1998 French ..... 340/571
5,767,771 A * 6/1998 Lamont ..... 340/571
6,111,504 A * 8/2000 Packard et al. ..... 340/568.1
6,133,830 A * 10/2000 D'Angelo et al. ..... 340/571
7,127,270 B2 * 10/2006 Sinclair ..... 455/556.1
2004/0201477 A1 * 10/2004 Matoba et al. ..... 340/568.1
2005/0177769 A1 * 8/2005 Stephen-Daly et al. ..... 714/14

FOREIGN PATENT DOCUMENTS

JP 7-160955 A 6/1995
JP 2006-243201 A 9/2006

OTHER PUBLICATIONS

Office Action issued Sep. 4, 2009 in corresponding Chinese Patent Application No. 200710180330.3.

* cited by examiner

*Primary Examiner* — Benjamin C Lee
*Assistant Examiner* — Quang Pham
(74) *Attorney, Agent, or Firm* — Westerman, Hattori, Daniels & Adrian, LLP

(57) ABSTRACT

An image display device capable of preventing erroneous activation of the theft prevention function is provided. The image display device includes a theft prevention unit having an alarm function for preventing theft of the image display device, and a control circuit for controlling the theft prevention unit. The control circuit invalidates the alarm function of the theft prevention unit before the image display device is shipped out of a factory.

10 Claims, 3 Drawing Sheets

IMAGE DISPLAY DEVICE

CROSS-REFERENCE TO RELATED APPLICATIONS

This application is based upon and claims the benefit of priority from the prior Japanese Patent Application No. 2006-278873, filed on Oct. 12, 2006, the entire contents of which are incorporated herein by reference.

BACKGROUND OF THE INVENTION

The present invention relates to an image display device such as liquid crystal projector having a theft prevention function.

Image display devices, such as a liquid crystal projector, have become popular. A liquid crystal projector is compact, easy to carry, and relatively expensive. As a result, theft of liquid crystal projectors is increasing. This has increased the need for theft prevention measures.

Theft prevention measures include the setting of passwords or the use of PC cards so that a liquid crystal projector has a theft prevention function or the attachment of a theft prevention device to the liquid crystal projector.

Japanese Laid-Open Patent Publication No. 7-160955 discloses a theft prevention device connected to a liquid crystal projector by a multi-core cable. More specifically, the theft prevention device includes an alarm control device and an alarm device. The alarm control device is connected to the liquid crystal projector by a multi-core cable including a plurality of signal lines. The alarm device is connected to the alarm control device and receives a theft detection signal generated by the alarm control device. The alarm control device generates the theft detection signal, and sends the theft detection signal to the alarm device when the multi-core cable is cut or when the liquid crystal projector is disconnected from the multi-core cable to carry away the liquid crystal projector. The alarm device generates a warning such as buzzing sound.

However, in the conventional theft prevention device, the function of the theft prevention device, that is, the alarm function of the alarm device is valid from when the device is shipped out of a factory to when the user starts use. Therefore, the theft prevention function may be erroneously activated after the alarm device is shipped out of the factory and before the user starts use (e.g., when packaging or transporting the theft prevention device). In such a case, a warning such as buzzing sound is given off even though theft of the liquid crystal projector has not occurred. This creates undesirable noise.

SUMMARY OF THE INVENTION

The present invention provides an image display device that prevents erroneous activation of the theft prevention function.

One aspect of the present invention is an image display device for production in a factory. The image display device includes a theft prevention unit having an alarm function for preventing theft of the image display device. A control circuit controls the theft prevention unit. The control circuit invalidates the alarm function of the theft prevention unit before the image display device is shipped out of the factory.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
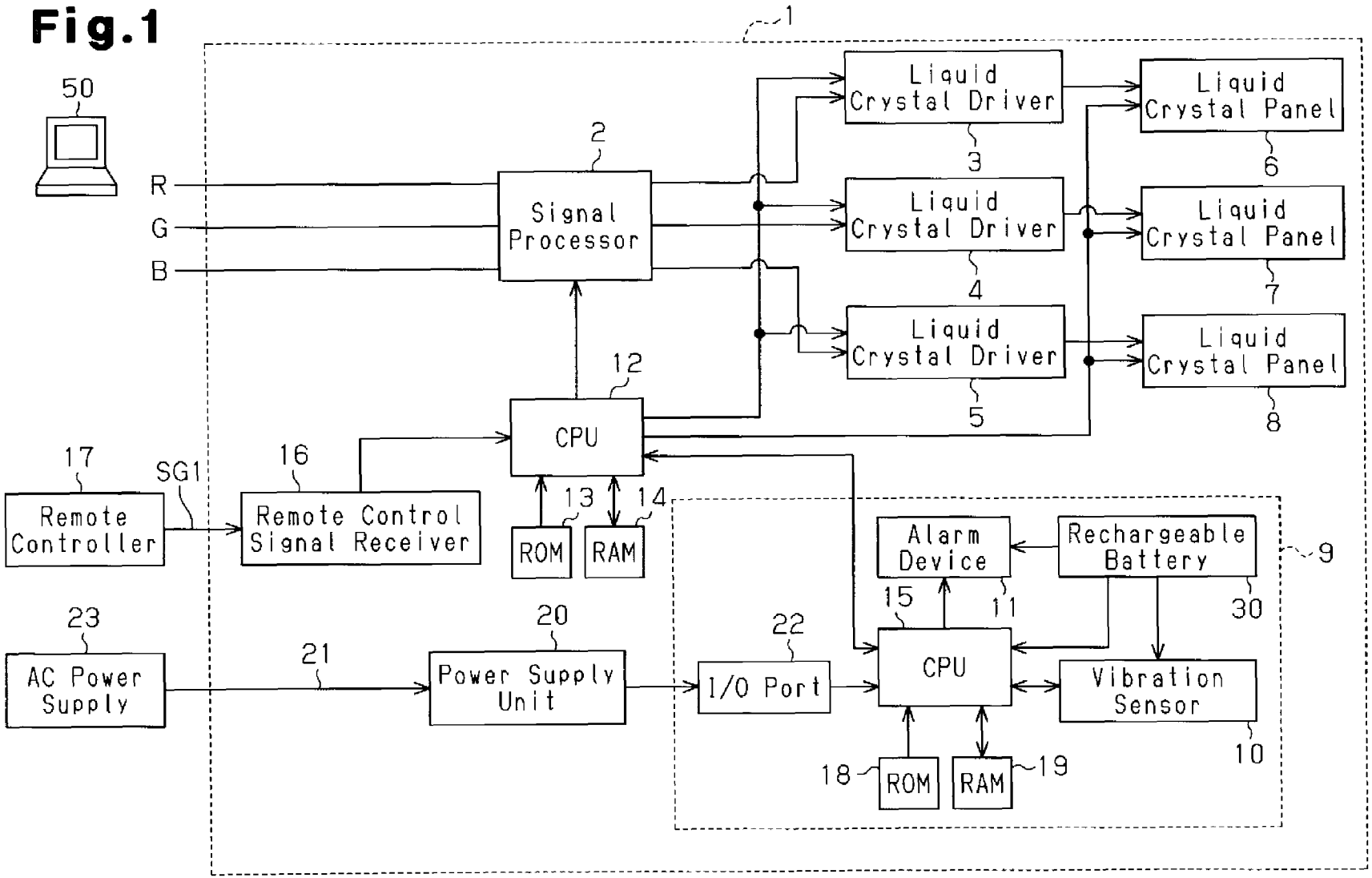
FIG. 1 is a schematic block diagram of an image display device according to a preferred embodiment of the present invention.

A liquid crystal projector 1 according to a preferred embodiment of the present invention will now be described with reference to the drawings. FIG. 1 is a schematic block diagram of the liquid crystal projector 1, which serves as an image display device of the present invention.

As shown in FIG. 1, the liquid crystal projector 1 includes a signal processor 2 for performing predetermined signal processing on an image signal (i.e., RGB video signal) provided from an external device such as computer 50 to the liquid crystal projector 1. The liquid crystal projector 1 also includes a red liquid crystal driver 3, a green liquid crystal driver 4, and a blue liquid crystal driver 5 (hereinafter referred to as "liquid crystal drivers 3 to 5"), which receive the image signal that has been signal-processed by the signal processor 2 and respectively drive a red liquid crystal panel 6, a green liquid crystal panel 7, and a blue liquid crystal panel 8 (hereinafter referred to as "liquid crystal panels 6 to 8").

A liquid crystal panel that incorporates a shift register and uses an active matrix type thin-film transistor (TFTs) is employed as the liquid crystal panels 6 to 8 driven by the liquid crystal drivers 3 to 5. More specifically, a liquid crystal panel including an effective pixel section with an m×n matrix of a plurality of pixels, a vertical scanning circuit for driving each scanning line, a horizontal scanning circuit for scanning each horizontal line, and a thin-film transistor serving as a switching element can be used.

The liquid crystal projector 1 includes a CPU 12, which serves as a control circuit for controlling the signal processor 2 and the liquid crystal drivers 3 to 5. The liquid crystal projector 1 also includes a ROM 13 and a RAM 14, each serving as a storage circuit. The ROM 13 and the RAM 14 are connected to the CPU 12. The CPU 12 controls the signal processor 2 and the liquid crystal drivers 3 to 5 in accordance with programs stored in the ROM 13.

A remote control signal receiver 16 is connected to the CPU 12. The remote control signal receiver 16 provides the CPU 12 with a remote signal SG1 received from a remote controller 17.

The liquid crystal projector 1 receives from a computer 50 image signals R, G, and B that are provided to the signal processor 2 and signal-processed. More specifically, if the image signals are analog signals, the signal processor 2 samples the image signals R, G, and B received from the computer 50 at appropriate timings and converts the sampled signals into digital signals. Furthermore, the signal processor 2 adjusts the brightness and contrast and performs gamma correction. The signal processor 2 then converts the image signals R, G, and B from digital signals to analog signals. In this manner, the signal processor 2 generates the signal processed image signals R, G, and B.

The image signals R, G, and B, which are signal processed by the signal processor 2, are provided to the liquid crystal drivers 3 to 5. The liquid crystal drivers 3 to 5 drive the liquid crystal panels 6 to 8 based on the image signals R, G, and B, respectively. More specifically, the liquid crystal driver 3 performs AC inversion on the image signal R at a predetermined timing and provides and drives the liquid crystal panel 6 with the AC-inverted image signal R. The liquid crystal driver 4 performs AC inversion on the image signal G at a predetermined timing and provides and drives the liquid crystal panel 7 with the AC-inverted image signal G. The liquid crystal driver 5 performs AC inversion on the image signal B at a predetermined timing and provides and drives the liquid crystal panel 8 with the AC-inverted image signal B.

Each of the liquid crystal panels 6 to 8 writes the image signal R, G, and B that have been AC-inverted by the liquid crystal drivers 3 to 5 to a predetermined pixel while controlling write transfer in the horizontal direction and the vertical direction based at predetermined timings. This forms an image with each of the liquid crystal panels 6 to 8.

Light from a light source (not shown) is transmitted through the images formed by the liquid crystal panels 6 to 8. This generates image lights of red (R), green (G), and blue (B) colors. The generated image lights are synthesized by a cross-dichroic prism (not shown) and converted into color image light. A projection lens (not shown) magnifies and projects the color image light onto a screen.

The liquid crystal projector 1 has a theft prevention function. More specifically, the liquid crystal projector 1 includes a theft prevention unit 9 having an alarm function for preventing theft of the liquid crystal projector 1. The theft prevention unit 9 includes a vibration sensor 10 and an alarm device 11. The vibration sensor 10 serves as a detector for detecting theft of the liquid crystal projector 1. The alarm device 11 generates a warning such as buzzing sound when the vibration sensor 10 detects theft of the liquid crystal projector 1. The alarm device 11 functions as a notifier for notification of theft. Furthermore, the theft prevention unit 9 includes a CPU 15, a ROM 18, and a RAM 19. The CPU 15 serves as another control circuit, connected to the vibration sensor 10 and the alarm device 11, for controlling the vibration sensor 10 and the alarm device 11. The ROM 18 and RAM 19 each serve as a storage circuit and are connected to the CPU 15. The CPU 15 controls the theft prevention unit 9 in a centralized manner in accordance with programs stored in the ROM 18. The theft prevention unit 9 also includes a rechargeable battery 30 for supplying power to the vibration sensor 10, the alarm device 11, and the CPU 15.

In the preferred embodiment, the vibration sensor 10 uses a sensor capable of detecting vibrations caused by movement when the liquid crystal projector 1 is stolen. For example, an acceleration sensor or a distortion gauge sensor may be used as the vibration sensor 10. The alarm device 11 may be at least one of a voice output device (not shown), such as buzzer, and a display output device (not shown), such as a display lamp (e.g., LED).

The liquid crystal projector 1 includes a power supply unit 20 connected to the theft prevention unit 9. Power (AC voltage) is supplied from an AC power supply 23 to the power supply unit 20 through a power supply cable 21. The power supply unit 20 converts the AC voltage supplied from the AC power supply 23 into DC voltage to supply the power from the AC power supply 23 to the theft prevention unit 9.

As shown in FIG. 1, the theft prevention unit 9 includes an I/O port 22 serving as a power supply detector for detecting activation and deactivation of the AC power supply 23. The I/O port 22 is connected to the CPU 15 and the power supply unit 20. When power from the AC power supply 23 is supplied to the theft prevention unit 9, the AC power supply 23 generates a high signal, which is provided to the CPU 15 via the I/O port 22. In this case, the CPU 15 determines that the AC power supply 23 is in the activated state. When the AC power supply 23 does not supply power to the theft prevention unit 9, the AC power supply 23 generates a low signal, which is provided to the CPU 15 via the I/O port 22. In this case, the CPU 15 determines that the AC power supply 23 is in the deactivated state. In other words, the I/O port 22 serves as a port used by the CPU 15 to recognize the state of the AC power supply 23. The rechargeable battery 30 is charged by the power supplied from the AC power supply 23 in the activated state. When the AC power supply 23 is in deactivated state, power is supplied to the theft prevention unit 9 from the rechargeable battery 30.

The operation of the theft prevention unit 9 will now be discussed.

When a thief tries to steal the liquid crystal projector 1, the vibration sensor 10 detects vibrations of the liquid crystal projector 1. More specifically, if the vibration sensor 10 is an acceleration sensor, the acceleration sensor detects acceleration for three axes, which are in two horizontal and orthogonal directions (X axis and Y axis) and one vertical direction (Z axis) and detects vibration components of the liquid crystal projector 1. The values of the acceleration detected by the acceleration sensor are then provided to the CPU 15. The CPU 15 determines whether or not theft of the liquid crystal projector 1 is in progress based on the detection values of the acceleration sensor. More specifically, the CPU 15 calculates an inclination angle of the liquid crystal projector 1 based on the detection values of the acceleration sensor. Then, the CPU 15 compares the calculated inclination angle with a predetermined inclination angle of the liquid crystal projector 1 that is stored in the ROM 18.

If the calculated inclination angle is greater than the predetermined inclination angle in the ROM 18, the CPU 15 determines that theft of the liquid crystal projector 1 is in progress and generates a theft detection signal. In response to the theft detection signal, the alarm device 11 generates a warning, such as a buzzing sound, for an alert of the theft. In this manner, the alarm function of the theft prevention unit 9 is activated by the activation of the vibration sensor 10 and the alarm device 11.

If the inclination angle calculated from the detection value of the acceleration sensor is less than the predetermined inclination angle, the CPU 15 determines that theft of the liquid crystal projector 1 is not in progress and does not generate the theft detection signal. Therefore, the alarm device 11 is not operated, and a warning, such as buzzing sound, for notification of a theft is not generated.

The theft prevention unit 9 operates in an anti-theft valid mode and an anti-theft invalid mode. In the anti-theft valid mode, the alarm device 11 generates a warning when the vibration sensor 10 detects vibrations. In the anti-theft invalid mode, the alarm device 11 does not generate a warning even if the vibration sensor 10 detects vibrations. The two modes are switched by operating a switch (not shown) arranged in the theft prevention unit 9. When in the anti-theft valid mode, the alarm function of the theft prevention unit 9 is valid.

The prevention of erroneous activation of the alarm function in the theft prevention unit 9 will now be described. FIG.

2 is a flowchart showing the procedures for preventing erroneous activation of the theft prevention device in the liquid crystal projector 1 of FIG. 1. The flowchart shows the procedures that are carried out before the liquid crystal projector 1 incorporating the theft prevention unit 9 is shipped out of a factory.

Figure 2:
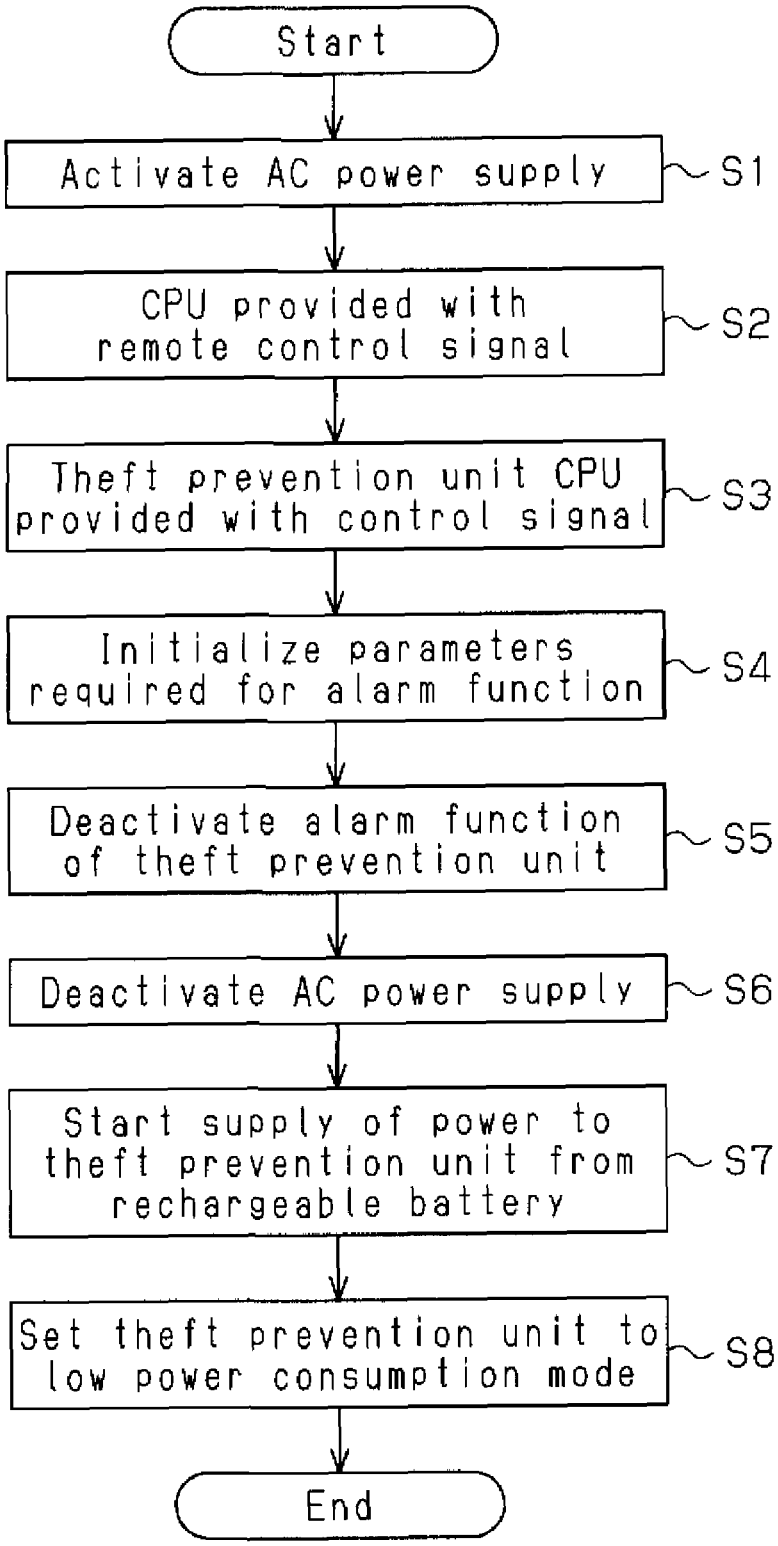
FIG. 2 is a flowchart showing the procedures of preventing erroneous activation of a theft prevention device for the image display device of FIG. 1.

As shown in FIG. 2, the AC power supply 23 is first activated so that adjustment of each unit (signal processor 2 and liquid crystal drivers 3 to 5) is performed in the liquid crystal projector 1 (step S1). The remote control signal receiver 16 receives the remote control signal SG1, which is for performing factory shipment setting on the theft prevention unit 9, from the remote controller 17, and provides the remote control signal SG1 to the CPU 12 (step S2). "Factory shipment setting" is performed to set initial values for parameters related with the alarm function of the theft prevention unit 9. Such parameters include volume and buzzing time of the alarm device 11 and sensitivity of the vibration sensor 10. The CPU 12 then generates a control signal for controlling the theft prevention unit 9 based on the remote control signal SG1 and provides the control signal to the CPU 15 of the theft prevention unit 9 (step S3). The CPU 15 sets initial values for various parameters related with the alarm function of the theft prevention unit 9 in the ROM 18 based on the provided control signal (step S4). After setting the initial values, the CPU 15 invalidates the alarm function of the theft prevention unit 9 (step S5). In other words, the CPU 15 invalidates the functions of the vibration sensor 10 and the alarm device 11 based on the provided control signal. After the functions of the vibration sensor 10 and the alarm 11 are invalidated, switching between the anti-theft valid mode and the anti-theft invalid mode cannot be performed even if the switch (not shown) arranged in the theft prevention unit 9 is operated.

In this manner, the CPU 12 invalidates the alarm function of the theft prevention unit 9 before the liquid crystal projector 1 is shipped out of the factory. Therefore, after shipment from the factory (e.g., when packaging or transporting the theft prevention device), the alarm function of the theft prevention unit 9 is prevented from being erroneously activated until the user starts use.

After the liquid crystal projector 1 is deactivated, the AC power supply 23 is deactivated (step S6). The AC power supply 23 generates a low signal and provides the low signal to the CPU 15 via the I/O port 22. Therefore, the CPU 15 determines (detects) that the AC power supply 23 is deactivated. This stops the supply of power from the AC power supply 23 to the theft prevention unit 9 and starts the supply of power from the rechargeable battery 30 to the theft prevention unit 9 (step S7). The CPU 15 sets the theft prevention unit 9 to a low power consumption mode (or standby mode) (step S8). Specifically, the CPU 15 deactivates the function of each unit (e.g., ROM 18 and RAM 19) except for the CPU 15 and the I/O port 22 in the theft prevention unit 9 to suppress drainage of the rechargeable battery 30 when the AC power supply 23 is deactivated (i.e., when power is not being supplied from the AC power supply 23). The liquid crystal projector 1 is then shipped out of the factory.

Figure 3:
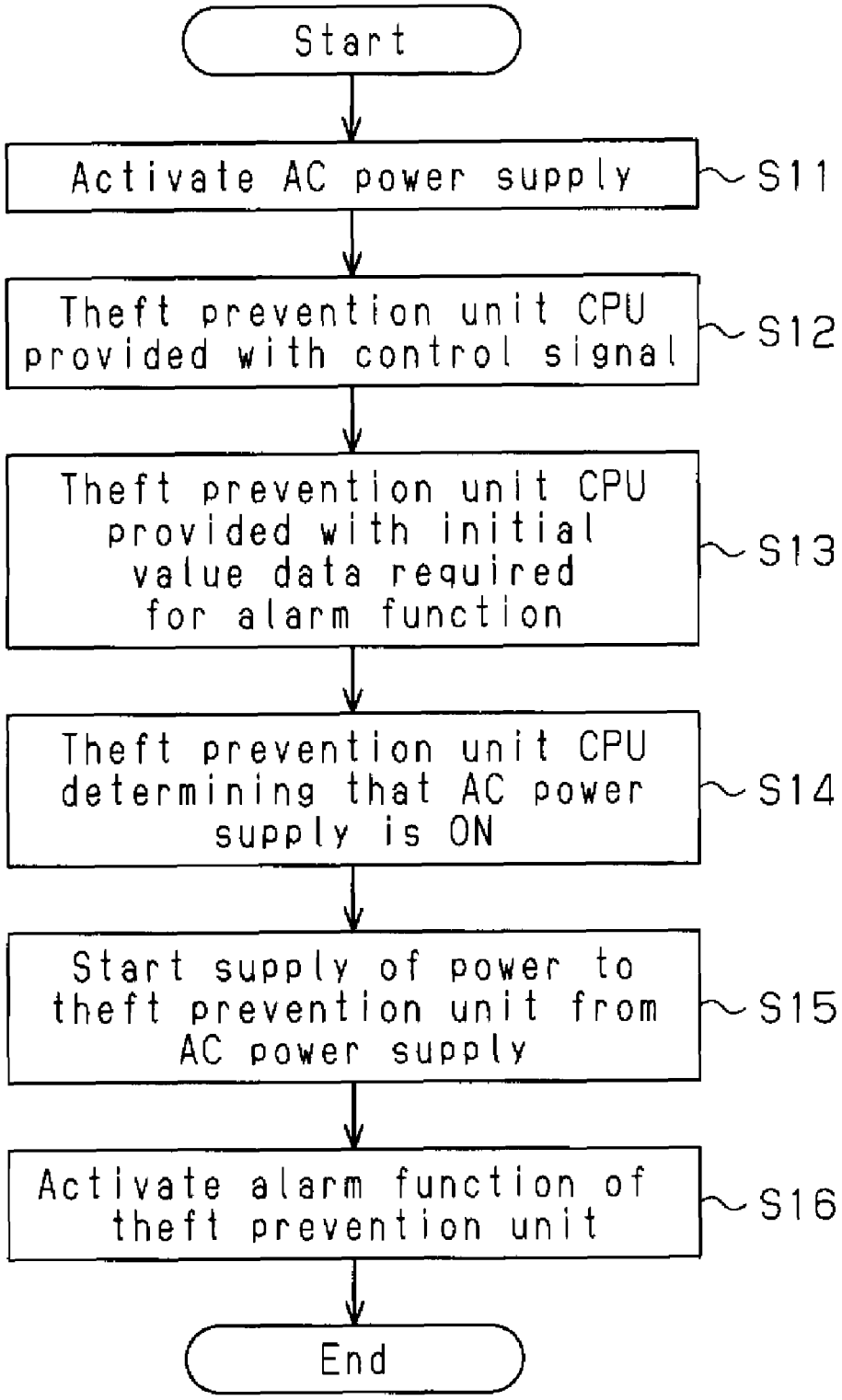
FIG. 3 is a flowchart showing the procedures for validating an alarm function of the theft prevention device for the image display device of FIG. 1.

Validation of the alarm function will now be described. FIG. 3 is a flowchart showing procedures for validating the alarm function of the theft prevention device in the liquid crystal projector 1 of FIG. 1. The flowchart shows the procedures taken when the user starts to use the liquid crystal projector 1 incorporating the theft prevention unit 9 that has been shipped out of the factory.

As shown in FIG. 3, the AC power supply 23 is activated to start the use of the liquid crystal projector 1. This starts the supply of power from the AC power supply 23 (step S11). The CPU 12 then generates the control signal for validating the alarm function of the theft prevention unit 9 and provides the control signal to the CPU 15 (step S12). The CPU 15 causes the theft prevention unit 9 to exit the low power consumption mode, which has been set before factory shipment, reads the initial value data of various parameters related with the alarm function of the theft prevention unit 9 from the ROM 18, and provides the initial value data to the CPU 12 (step S13). Then, the AC power supply 23 generates and provides a high signal to the CPU 15 via the I/O port 22. Therefore, the CPU 15 determines (detects) that the AC power supply 23 is activated (step S14). As a result, the supply of power from the rechargeable battery 30 is stopped, and the supply of power from the AC power supply 23 is started (step S15). The CPU 15 validates the alarm function of the theft prevention unit 9 based on the control signal provided from the CPU 12 (step S16). More specifically, the CPU 15 activates the vibration sensor 10 and the alarm device 11 based on the provided control signal.

The CPU 12 operates the alarm function of the theft prevention device when the supply of power from the AC power supply 23 starts after factory shipment of the liquid crystal projector 1. Therefore, the alarm function of the theft prevention unit 9 becomes valid through a simple structure when the user starts using the liquid crystal projector 1 that has been shipped out of the factory.

After activating the functions of the vibration sensor 10 and the alarm device 11, the anti-theft valid mode and the anti-theft invalid mode may be switched by operating the switch (not shown) arranged in the theft prevention unit 9. Therefore, the user can set the anti-theft valid mode whenever necessary.

The liquid crystal projector 1 of the preferred embodiment has the advantages described below.

(1) The liquid crystal projector 1 includes the theft prevention unit 9, which has an alarm function for preventing theft of the liquid crystal projector 1, and the CPU 12, which generates the control signal for controlling the theft prevention unit 9. The CPU 12 invalidates the alarm function of the theft prevention unit 9 before the liquid crystal projector 1 is shipped out of a factory. Therefore, the alarm function of the theft prevention unit 9 is prevented from being erroneously activated from when the liquid crystal projector 1 is shipped out of the factory until when the user starts using the liquid crystal projector 1 (e.g., when packaging or transporting the liquid crystal projector 1). This prevents the generation of a warning, such as buzzing sound, caused by erroneous activation of the alarm function.

(2) The theft prevention unit 9 includes the vibration sensor 10 for detecting theft of the liquid crystal projector 1, the alarm device 11 for notification of theft of the liquid crystal projector 1 based on the detection result of the vibration sensor 10, and the CPU 15 for controlling the vibration sensor 10 and the alarm device 11. The CPU 15 deactivates the vibration sensor 10 and the alarm device 11 based on the control signal generated by the CPU 12. Therefore, erroneous activation of the alarm function of the theft prevention unit 9 is easily prevented by the control signal of the CPU 12.

(3) The theft prevention unit 9 further includes the rechargeable battery 30 for supplying power to the theft prevention unit 9. When the supply of power from the AC power supply 23 is stopped, the rechargeable battery 30 supplies power to the theft prevention unit 9. When power is supplied from the rechargeable battery 30 to the theft prevention unit 9, the CPU 15 sets the theft prevention unit 9 to the low power consumption mode. This effectively suppresses drainage of the rechargeable battery 30 until the user starts to use the liquid crystal projector 1 that has been shipped out of the factory.

(4) When the supply of power from the AC power supply 23 is started after the liquid crystal projector 1 is shipped out of the factory, the CPU 12 validates the alarm function of the theft prevention unit 9. Therefore, the alarm function of the theft prevention unit 9 is validated through a simple structure when the user starts to use the liquid crystal projector 1 after the liquid crystal projector 1 is shipped out of the factory. As a result, the troublesome operations are unnecessary, and convenience for the user is improved.

(5) The CPU 15 activates the functions of the vibration sensor 10 and the alarm device 11 based on the control signal generated by the CPU 12. Therefore, the CPU 15 validates the alarm function of the theft prevention unit 9 with a simple structure based on the control signal of the CPU 12.

It should be apparent to those skilled in the art that the present invention may be embodied in many other specific forms without departing from the spirit or scope of the invention. Particularly, it should be understood that the present invention may be embodied in the following forms.

When using the liquid crystal projector 1, the anti-theft valid mode may be canceled by operating a button (not shown) arranged in the theft prevention unit 9 and inputting a password. This would prevent a person other than the user from canceling the anti-theft valid mode.

A further notifier (not shown) for providing notification of drainage of the rechargeable battery 30, the setting of anti-theft valid mode, and changes in the password may be arranged in the theft prevention unit 9. For example, an LED may be arranged as the further notifier. In this case, for example, the LED is lighted for a predetermined time (e.g., 20 seconds) when the rechargeable battery 30 is drained to notify the user that the rechargeable battery is drained.

The image display device of the present invention is not limited to the liquid crystal projector 1 that uses a liquid crystal panel and is applicable to an image display devices incorporating other image light generation systems.

Furthermore, the image display device of the present invention may be a front projection type image display device or a rear projection type image display device.

The present examples and embodiments are to be considered as illustrative and not restrictive, and the invention is not to be limited to the details given herein, but may be modified within the scope and equivalence of the appended claims.

What is claimed is:

1. An image display device for production in a factory and for use with a power supply, the image display device comprising:

a theft prevention unit having an alarm function for preventing theft of the image display device; and a control circuit for controlling the theft prevention unit, in which the control circuit responsive to a remote control signal invalidates the alarm function of the theft prevention unit before the image display device is shipped out of the factory, and activates the alarm function when the power supply starts supplying power.

2. The image display device according to claim 1, wherein the theft prevention unit includes:

a detector for detecting theft of the image display device and generating a detection result;

a notifier for providing notification of theft of the image display device based on the detection result of the detector; and a further control circuit for controlling the detector and the notifier, wherein the further control circuit is controlled by the control circuit.

3. The image display device according to claim 2, wherein:

the control circuit generates a control signal for controlling the further control circuit; and the further control circuit deactivates the detector and the notifier based on the control signal generated by the control circuit before the image display device is shipped out of the factory.

4. The image display device according to claim 3, wherein the further control circuit activates the detector and the notifier based on the control signal after the image display device is shipped out of the factory when the power supply starts supplying power.

5. The image display device according to claim 4, wherein:

the image display device is connected to an AC power supply for supplying power to the image display device; and the further control circuit activates the detector and the notifier when the AC power supply starts supplying power.

6. The image display device according to claim 2, wherein the detector is a vibration sensor.

7. The image display device according to claim 2, wherein the notifier includes at least one of a voice output device and a display output device.

8. The image display device according to claim 2, wherein the theft prevention unit further includes a storage circuit for storing a functional parameter for the detector and a functional parameter for the notifier.

9. The image display device according to claim 1, wherein:

the image display device is connected to an AC power supply for supplying power to the image display device; and the theft prevention unit further includes a battery capable of supplying power to the theft prevention unit, the battery supplying power to the theft prevention unit when the AC power supply stops supplying power, and the further control circuit sets the theft prevention unit to a low power consumption mode when the battery supplies power to the theft prevention unit.

10. The image display device according to claim 9, wherein the control circuit validates the alarm function of the theft prevention unit when the AC power supply starts supplying power after the image display device is shipped out of the factory.

* * * * *